United States Patent [19]

Inoue et al.

[11] Patent Number: 4,954,085

[45] Date of Patent: Sep. 4, 1990

[54] WIRING STRUCTURE

[75] Inventors: Toshihiro Inoue; Kazuhiro Ozawa, both of Utsunomiya, Japan

[73] Assignee: Honda Giken Kogyo Kabushiki Kaisha, Tokyo, Japan

[21] Appl. No.: 216,066

[22] Filed: Jul. 7, 1988

[30] Foreign Application Priority Data

| | | | |
|---|---|---|---|
| Jul. 24, 1987 | [JP] | Japan | 62-183689 |
| Jul. 24, 1987 | [JP] | Japan | 62-183690 |
| Jul. 31, 1987 | [JP] | Japan | 62-190382 |
| Jul. 31, 1987 | [JP] | Japan | 62-190383 |
| Jul. 31, 1987 | [JP] | Japan | 62-190384 |

[51] Int. Cl.[5] ..... H01R 33/74

[52] U.S. Cl. ..... 439/34; 439/364

[58] Field of Search ..... 439/34, 35, 364; 179/72 A; 180/90; 307/10.1

[56] References Cited

U.S. PATENT DOCUMENTS

| | | | |
|---|---|---|---|
| 2,058,923 | 10/1936 | Swallow | 180/90 X U |
| 3,146,052 | 8/1964 | Burch et al. | 439/34 |
| 3,853,381 | 12/1974 | Morningstar et al. | 439/364 |
| 4,602,317 | 7/1986 | Rovnyak et al. . | |
| 4,640,570 | 2/1987 | Strate . | |
| 4,684,190 | 8/1987 | Clark et al. | 439/364 X |

FOREIGN PATENT DOCUMENTS

| | | |
|---|---|---|
| 60876 | 1/1975 | Japan . |
| 54-116694 | 9/1979 | Japan . |
| 1032895 | 6/1966 | United Kingdom . |
| 2131594A | 12/1984 | United Kingdom . |
| WO82/00925 | 3/1982 | World Int. Prop. O. . |
| WO87/00976 | 2/1987 | World Int. Prop. O. . |

OTHER PUBLICATIONS

Research Disclosures, Apr. 1987, Disclosure 27621, "Printed Circuit Board Stacking Fastener System".

*Primary Examiner*—Eugene F. Desmond

*Attorney, Agent, or Firm*—Armstrong, Nikaido, Marmelstein, Kubovcik & Murray

[57] ABSTRACT

A wiring structure for electric wirings in a vehicle or the like. A horizontal partition wall portion that is nearly horizontal is provided in a dashboard partitioning a car room from an engine room provided outside of that car room, and an end portion of an outdoor side harness within the engine room is positioned above the horizontal partition wall portion, while an end portion of an indoor side harness within the car room is positioned under the horizontal partition wall portion. And, one connector provided at the end portion of the indoor side harness and the other connector provided at the end portion of the outdoor side harness are joined with each other penetrating through the horizontal partition wall portion. The above-mentioned one connector is a waiting connector slidably supported from a connector guide mounted to the horizontal partition wall portion, and a nut directed in the sliding direction is fixed thereto. A bolt rotatably supported from the other connector is threadedly engaged with this nut, and by rotating that bolt, the respective connectors are brought close to each other and thus joined together.

10 Claims, 19 Drawing Sheets

WIRING STRUCTURE

BACKGROUND OF THE INVENTION

The present invention relates to a wiring structure for electric wirings in a motorcar. The present invention also relates to a junction structure to be used in the case of connecting wire harnesses with each other by means of connectors.

Electric wirings in a motorcar are distributed normally from a battery disposed within an engine room through a relay box provided in the proximity of the battery to respective devices disposed on the outdoor side or on the indoor side. It is a common practice in the prior art that the wirings to the indoor side is distributed by bundling the cords to be distributed to the respective devices on the indoor side and making the bundle of cords pass through a bore drilled in a partition wall separating the outdoor side and the indoor side from each other.

However, the number of the cords to be distributed to the indoor side is so many that it was troublesome to make these cords pass through the bore provided in the partition wall and lead them to a relay box. Moreover, the bundled cords would have an unexpectedly large diameter as a whole, hence the bore provided in the partition wall for making the bundle pass therethrough also has a large diameter, and it was difficult to seal the passing portion.

For the purpose of connecting wirings, generally connectors are employed. In the connection by means of connectors, by mutually fitting a pair of connectors having connecting elements, respectively, to each other, the respective connecting elements are connected to each other. For instance, a structure of such type of connectors is disclosed in Laid-Open Japanese Utility Model Specification No. 48-23367 (1973). In this connector structure, connecting elements provided in one connector are mere protrusions, while connecting elements provided in the other connector have fitting slots formed therein, and the respective connecting elements are connected to each other by the above-mentioned protrusions being inserted and fitted in the aforementioned slots.

While it can be done easily with a weak force to join and separate a pair of connectors to and from each other when the number of the connecting elements to be inserted and fitted is small, when the connecting elements are provided so many, the force required for the joining and separation would become large as a result of summing up, and so, they cannot be joined and separated in a simple manner. When one of the connector is fixed on a support plate or the like a large stress would be applied to the support plate upon joining or separation, and hence, there was a problem because the support plate may be damaged.

In addition, if the respective connectors are not exactly joined, the protrusions forming the connecting elements of one connector would not be inserted and fitted to the fitting slots forming the connecting elements of the other connector, and so, either electrical connection therebetween would not be made or faulty connection would be made. Moreover, sometimes the connecting elements would be damaged or would give damage to other portions.

SUMMARY OF THE INVENTION

One object of the present invention is to provide a wiring structure in a vehicle, for which wiring work and maintenance are easy.

Another object of the present invention is to provide a joint structure for wirings, in which joint and separation of connectors to and from each other can be achieved easily with a small force without applying any force to a support member.

Still another object of the present invention is to provide a connector arrangement, in which a pair of connectors can be joined exactly with each other.

According to one feature of the present invention, the above-mentioned first object can be achieved by a wiring structure in a vehicle, in which a horizontal partition wall portion directed in the nearly horizontal direction is formed in a partition wall bounding the indoor side and the outdoor side of the vehicle, an end portion of a harness disposed on the outdoor side is positioned above the aforementioned horizontal partition wall portion, while an end portion of a harness disposed on the indoor side is positioned under the aforementioned horizontal partition wall portion, and these end portions are connected with each other as penetrating through the horizontal partition wall portion.

According to the present invention having the above-described feature, the work of making cords pass through a bore provided in a partition wall separating the indoor side and the outdoor side from each other is unnecessary, and since it is only necessary to lead the end portions of the indoor side harness and the outdoor side harness, respectively, concentrically to the connecting locations above and under the nearly horizontal partition wall portion, the wiring work is simple and the maintenance is also extremely easy.

According to another feature of the present invention, the above-described second object can be achieved by a wiring joint structure comprising a pair of connectors respectively provided with connecting elements, which are connectable with each other, a connector guide for slidably supporting one of the connectors, a nut member fixed to the aforementioned one connector as directed in the sliding direction thereof, and a bolt member provided rotatably at a predetermined position on the other connector, in which provision is made such that by making the respective connectors butt against each other in a predetermined positional relationship and rotating the above-mentioned bolt member, the bolt member is threadedly inserted into the nut member, in response to this insertion the above-mentioned one connector would slide along the aforementioned connector guide, and thereby the above-described connecting elements provided in the respective connectors can be connected with each other.

According to the present invention having the above-described second feature, since by rotating the bolt member, one connector would slide and the respective connecting elements would connect with each other, the respective individual connectors can be easily made to join to each other with a small force for rotating the bolt member. Accordingly, even if a large number of connecting elements are provided in a connector, joint and separation can be effected with a small force. Moreover, the torques exerted upon the nut member and the bolt member are all received by the connectors, and hence, no force is applied to members supporting the respective connectors.

According to still another feature of the present invention, the above-mentioned third object can be achieved by a connector arrangement comprising a pair of connectors respectively provided with mutually connectable connecting elements, a bolt rotatably supported from one of the above-described connectors, a nut fixed at a position on the other connector corresponding to the aforementioned bolt, guide means for guiding relative movement of the above-mentioned respective connectors when they are being joined, and protective means for preventing the tip end of the above-described bolt from butting against any portion other than the nut on the other connector upon joining of the respective connectors.

According to the present invention having the above-described third feature, since the relative movement of the respective connectors is guided by the guide means when the connectors are joined, the connecting elements can be exactly connected with each other. In addition, damage of the connectors can be precluded by the protective means for preventing the tip end of the bolt from butting against any portion other than the nut of the other connector.

DETAILED DESCRIPTION OF THE PREFERRED EMBODIMENTS

Figure 1:
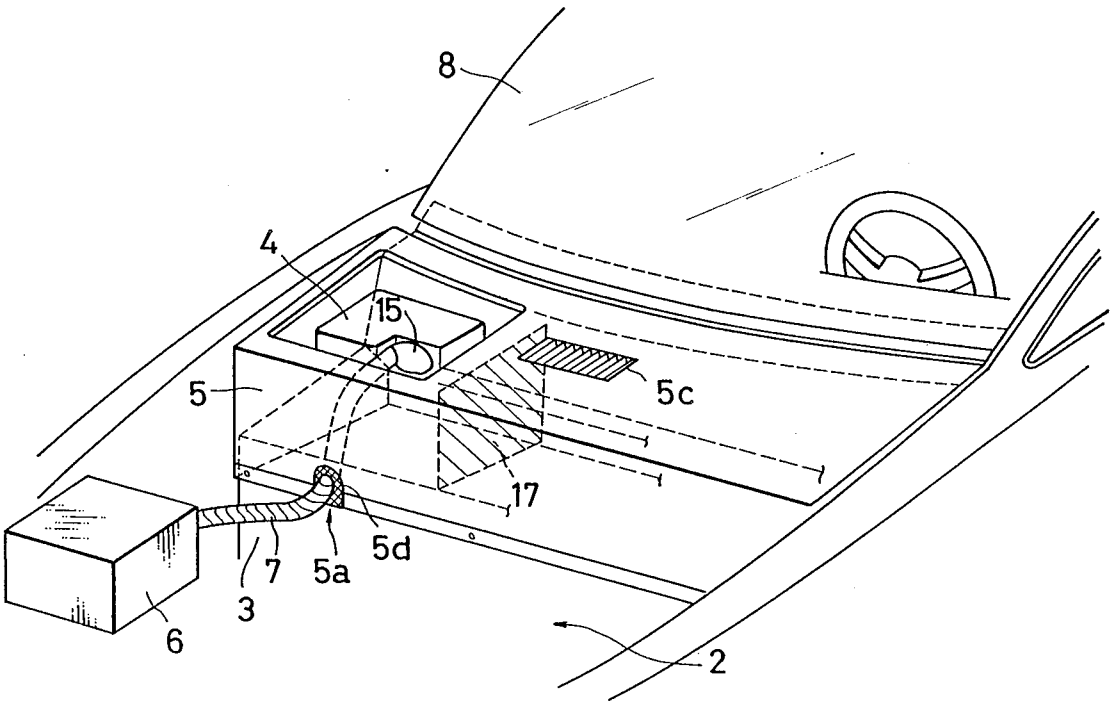
FIG. 1 is a perspective view showing an essential portion within an engine room of a motorcar embodying the present invention.
Figure 2:
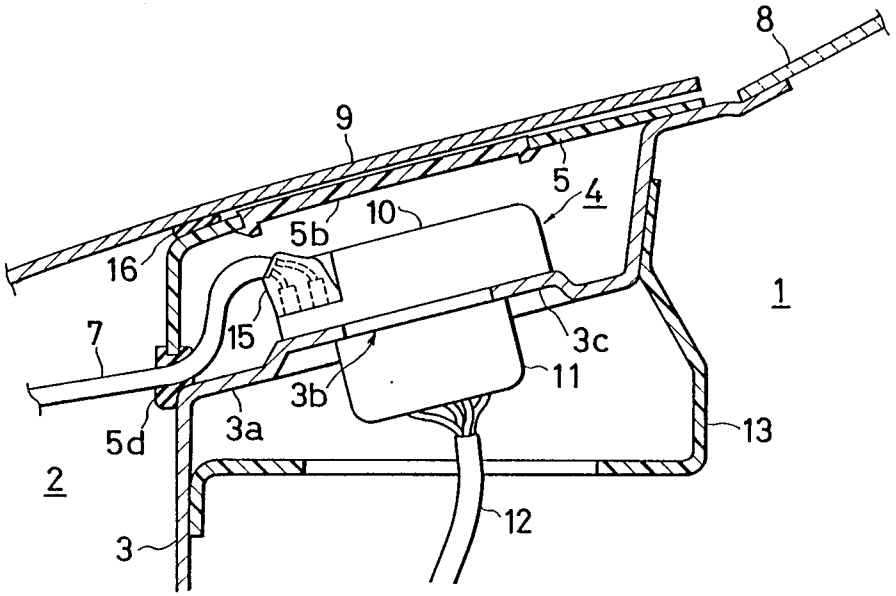
FIG. 2 is a vertical cross-section view of a joint box portion in FIG. 1.
Figure 3:
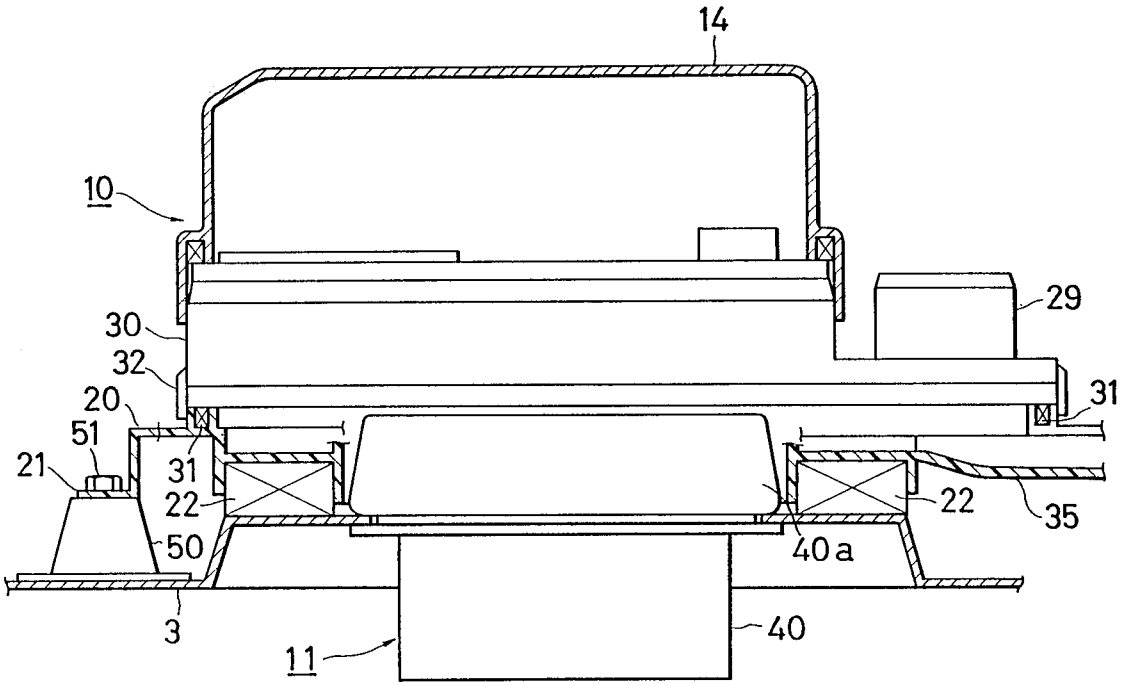
FIG. 3 is a schematic view showing the inside of the joint box.

FIG. 1 and 2 show an essential portion within an engine room of a motorcar embodying the present invention. Between a car room 1 and an engine room 2 located on the outside of the car room 1 is disposed a dashboard 3 for separating them from each other, as extending nearly vertically over the lateral width. A joint box 4 is disposed above the dashboard 3 and at the right end portion in the widthwise direction of a car body, that is, at the end portion on the side of the assistant's seat, where operating implements such as a handle, pedals and the like are not present. A resin cover 5 covers the top of the dashboard 3, and in that resin cover 5 is formed an opening at the portion corresponding to the joint box 4. The opening is to be closed by a lid **5*b***.

At the center of a nearly horizontal surface of the resin cover 5 is provided an air intake port **5*c*, and the space between the dashboard 3 and the resin cover 5 is divided by a partition wall 17 into the side where the joint box 4 is present and the other side where the air intake port 5*c*** is present.

To the joint box 4 is connected an outdoor side wire harness 7 extending from a battery 6, and the connecting portion is water-tightly covered by a rubber boot 15. The outdoor side wire harness passes through a notch **5*a* provided at the bottom edge portion of a vertical plane of the resin cover 5, and a seal member 5*d* is associated with the notch 5*a* along its contour. This seal member 5*d* air-tightly covers the outer circumference of the outdoor side wire harness 7 from above, and prevents the gas within the engine room 2 from entering into the car room 1 in cooperation with the partition wall 17**.

Reference numeral 8 designates a front window. In front of the front window 8 is positioned a bonnet 9, and the above-described dashboard 3 is provided at the rear lower position of the bonnet 9. Between the upper surface of the front end portion of the resin cover 5 and the lower surface of the bonnet 9 is pinched a seal member 16 as extending in the widthwise direction of the car body, and the seal member 16 prevents the gas within the engine room 2 from entering into the car room 1 through the air intake port **5*c***.

The above-mentioned dashboard 3 has its upper portion **3*a* bent in parallel to the bonnet 9 (nearly horizontally), and the joint box 4 is mounted to a partly raised rectangular portion 3*c* of the above-referred upper portion 3*a*. The joint box 4 consists of a relay box 10 which integrally contains one connector, and the other connector, that is, a waiting connector 11. The relay box 10 is positioned above a rectangular hole 3*b* provided in the dashboard 3, and cooperates with the lower waiting connector 11 adapted to be fitted thereto to pinch the dashboard 3 from the above and the below, and thereby it is fixed to the dashboard 3. The underside waiting connector 11 is covered by a cover member 13, and an indoor side wire harness 12 extending from the waiting connector 11 passes through a hole provided in the cover member 13 and further extends into the car room 1**.

As will be seen from FIGS. 3 to 7, the relay box 10 is composed of an outer case 20 forming an bottom wall, an inner case 30 superposed on the outer case 20 and accommodating various relays, fuses and the like, and a lid 14 covering the upper side of the inner case 30. The inner case 30 has the lower edge of its outside plate supported from the outer case 20 via a seal member 31, and a claw 33 projected upwards from the outer case 20 is adapted to be engaged with an engaging portion 32 provided in one part of the outside plate of the inner case 30. The outer case 20 is provided with a flange portion 21 at its outer peripheral portion, also on the inside of the outer case 20 is fixedly secured an annular seal member 22 having a rectangular cross-section, and further, on the inside of the seal member 22 are doubly provided guide plates 24 and 23 as projecting downwards. The inside guide plate 23 has a cylindrical or rectangular tubular shape, and the outside guide plate 24 has a rectangular tubular shape.

Between the outer case 20 and the inner case 30 are provided sheet-like separators 26 superposed in a vertical stack of four layers. Between these separators 26 and the outer case 20 is formed a drainage space 34 in the vicinity of the top of the seal member 22 so that water can be drained externally from that space through a drain hose 35 communicating with that space 34.

Bus bars (conductors) 27 are laid horizontally as sandwiched between the above-mentioned separators 26. These bus bars 27 bend downwards at predetermined positions between the above-described guide plates 23 and 24, then penetrate the separator or separators 26 located under the corresponding bus bars 27, the outer case 20 and a guide plate 28 and project therefrom, and they become connecting elements 27*a*. The guide plate 28 is disposed between the guide plate 23 and the guide plate 24 horizontally and in a vertically slidable manner, so that it can maintain the connecting elements 27*a* always at predetermined position. The bus bars 27 are electrically connected to the outdoor side wire harness 7 in a connecting section 29 by the intermediary of relays or fuses within the relay box.

At the central portion of the outer case 20 is provided a circular hole, and a bolt 60 is rotatably inserted into this circular hole from the above via a washer 61. At the upper end position of the threads formed on the lower half portion of the bolt 60 is formed a groove extending in the circumferential direction, and in this groove is fitted a stopper 62 forming a flange portion that is annular and upwardly expanded in a conical form, as restrained from vertical movement. In the outer case 20, on the inside of the inner guide plate 23 are concentrically formed a lower space 63 surrounded by that guide plate and an upper space 64 that is located above the lower space 63 and shaped in a circular columm having a smaller diameter. The above-described stopper 62 is loosely fitted in the upper space 64 and is restrained from upward movement by the top wall of the upper space 64. Accordingly the bolt would never be withdrawn upwardly.

The above-described relay box 10 forms one connector of a connector arrangement for joining the outdoor side wire harness 7 with the indoor side wire harness 12. The waiting connector 11 cooperating with this relay box 10 consists of a connector guide 40 fitted to the rectangular hole 3*b* in the dashboard 3 and a rectangular parallelepiped connector 41 supported within the former. The connector guide 40 has a rectangular tubular shape, and at its upper portion is formed a clip-like protrusion 40*a* bent into a wedge shape in cross-section, as projecting upwards. The bottom edge of an outside portion of the protrusion 40*a* is, after it has been once bent horizontally inwards, again bent outwards and thereby forms an elongated slot 40*b* directed in the horizontal direction. The edge portion of the rectangular hole 3*b* formed in the dashboard 3 fits in this elongated slot 40*b* with some margin left, and thereby the connector guide 40 is supported so as to permit some movement in the horizontal direction. Under the condition where the connector guide 40 is supported by the dashboard 3, the wedge-shaped protrusion 40*a* projects upwards from the dashboard 3. At the bottom edge portion of the tubular connector guide 40 is provided a lower stopper portion 40*c* somewhat projecting inwards, and an upper stopper portion 40*d* is projected at a predetermined position above the lower stopper portion 40*c*. Between the upper and lower stopper portions 40*d* and 40*c* is formed a gap space 40*e*.

The connector 41 has the shape adapted to fit into the above-described tubular connector guide 40. On the side surface near to the bottom edge of the connector 41 is formed a protrusion 41*a* as directed in the horizontal direction, and this protrusion 41*a* is positioned within the above-mentioned gap space 40*e* along the inner surface of the connector guide 40. Accordingly, the connector 41 is supported from the lower stopper portion 40*c* via the protrusion 41*a* and it can slide upwards until the protrusion 41*a* butts against the upper stopper portion 40*d*. The connector 41 has through-holes 42 directed in the vertical direction at the position corresponding to the connecting elements 27*a* on the above-described relay box 10. Though not illustrated, connecting terminals fixedly secured to the cord ends of the indoor side wire harness 12 are inserted and fitted in the through-holes 42, so that these connecting terminals can be connected to the above-mentioned connecting elements 27*a* incoming to the through-holes 42 as pinching the connecting elements 27*a*.

At the center of the connector 41 is provided an axial circular bore 44, and a nut 45 is fitted in and secured to the upper portion of the circular bore 44. In addition, at the position of the above-mentioned inner guide plate 23 of the relay box 10, a tubular guide slot 46 having a predetermined depth is formed in the connector 41 from its upper surface towards the below.

In the following, the joining process between the relay box 10 and the waiting connector 11 will be explained with reference to FIGS. 4 to 7.

Figure 4:
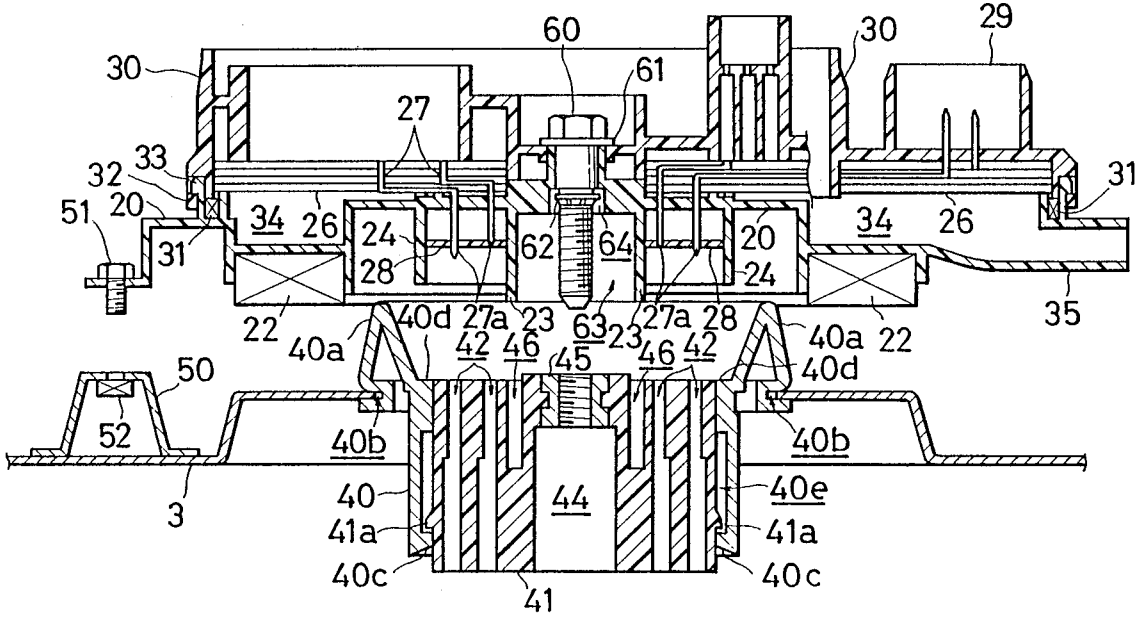
FIG. 4, 5, 6 and 7 are cross-section views showing the successive steps of a joining process between a relay box and a waiting connector in the same joint box.

At first, the connector 41 is fitted into the connector guide 40, and the connecting terminals at the cord ends of the indoor side wire harness 12 are fitted into the through holes 42 in the connector 41 from below (not shown). The connector guide 40 having the connector 41 fitted therein in the above-described manner, is inserted into the rectangular hole 3*b* in the upper portion 3*a* of the dashboard 3 from below while the wedge-shaped protrusion 40*a* is being somewhat deformed, and the inner edge of the dashboard 3 is fitted in the elongated slot 40*b* with a little gap space left therein. The state where the aforementioned condition has been established and the relay box 10 is held separated from the waiting connector 11 is shown in FIG. 4.

Figure 5:
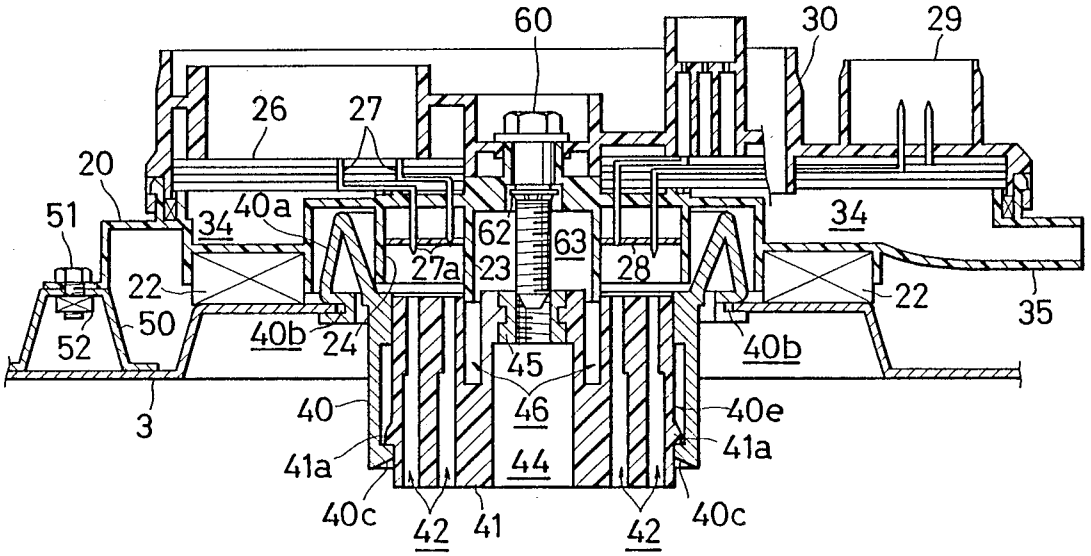
Figure 6:
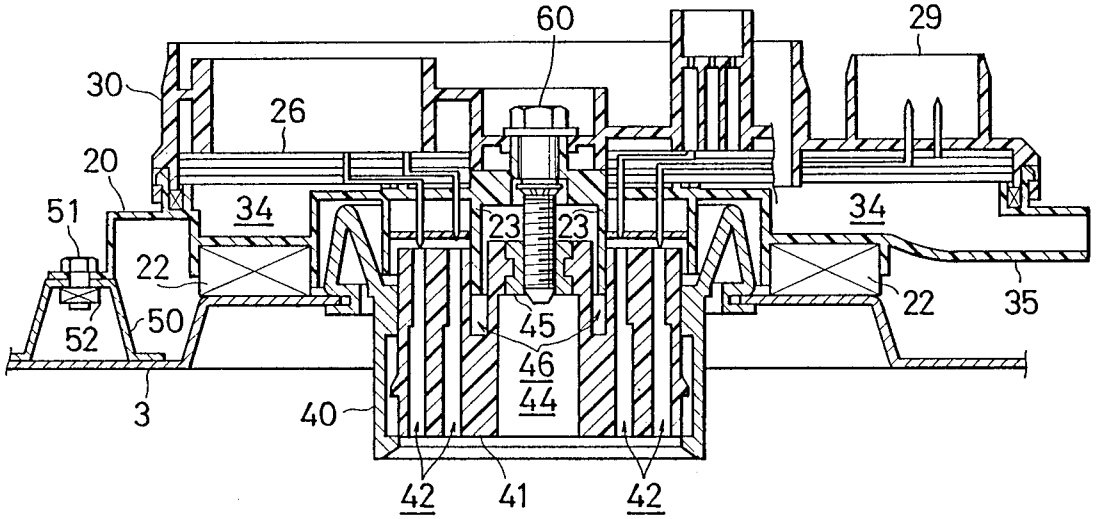

Then, the relay box 10 is placed on the waiting connector 11 with their center axes approximately aligned with each other. At this time, the upwardly projecting wedge-shaped protrusion 40*a* of the connector guide 40 would guide the guide plate 24 in the relay box side with its inwardly tapered surface, and since the connector guide 40 can move a little in the horizontal direction relatively to the dashboard 3 owing to the above-mentioned elongated slot 40*b*, relative positioning between the relay box 10 and the waiting connector 11 can be achieved, and so, the bolt 60 and the nut 45 can exactly align on the same axis. This state is shown in FIG. 5. The relay box 10 is placed on the dashboard 3 via the seal member 22, and the tip end of the bolt 60 butts against the nut 45 in the connector 41 as somewhat entering into the nut 45. Under this condition, the flange 21 of the outer case 20 is fixedly secured to a bracket 50 by means of bolts 51 and nuts 52.

Thereafter, when the bolt 60 is rotated, the nut 45 comes into thread engagement with the bolt 60, and so, the connector 41 integrated with the nut 45 rises in accordance with the rotation of the bolt 60. The connector 41 is guided by the guide plate 23 on the side of the relay box 10 inserted into the guide slot 46, and continues to rise without being displaced in the horizontal direction (See FIG. 6). When the connector 41 has risen up to a predetermined position, the connecting elements 27*a* having their positions in the horizontal direction maintained by the guide plate 28, are exactly caught by the corresponding through-holes 42 and inserted into these through-holes 42. Then, the connecting terminals (not shown) at the cord ends which were preliminarily fitted into the through-holes 42 as described above, would pinch the respective connecting elements 27*a*, and thereby, electrical connection can be made. It is to be noted that after the top surface of the connector 41 has butted against the guide plate 28, the guide plate 28 would rise integrally with the connector 41.

Figure 7:
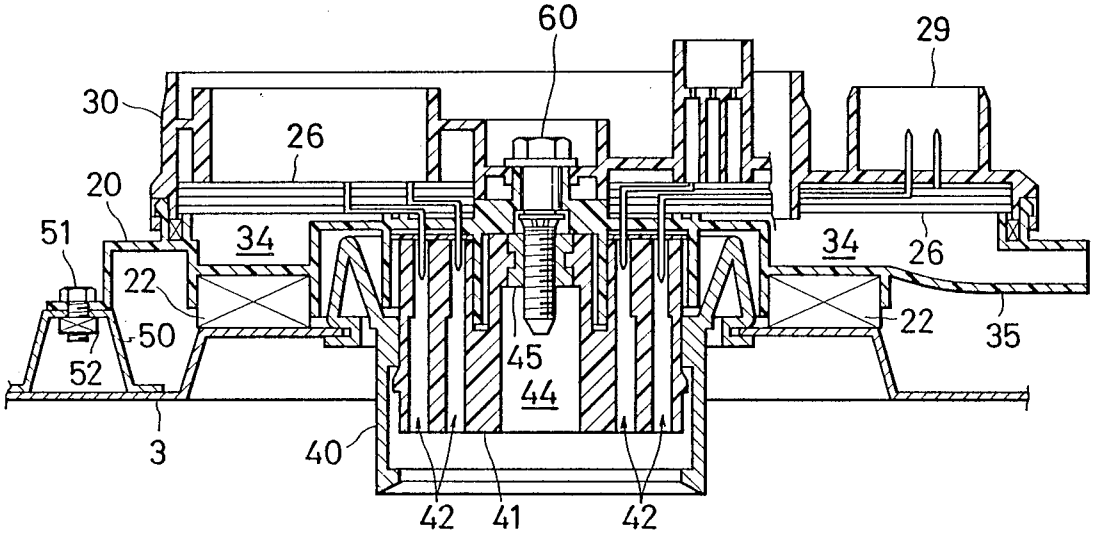

When the top surface of the nut 45 and/or the top surface of the cylindrical portion supporting the same nut 45 comes into contact with the ceiling portion of the above-mentioned lower space 63 inside of the guide plate 23, the rise of the connector 41 stops, and then joining between the relay box 10 and the waiting connector 11 is completed (See FIG. 7). At this moment, a little space is left above the guide plate 28 which has risen jointly with the connector 41. When the joining within the joint box 4 has been done in the above-described manner, the outdoor side harness 7 would be connected to the indoor side wire harness 12 through relays (or fuses), the bus bars, 27, connecting elements 27*a* and the connecting terminals on the side of the connector 41.

When the relay box 10 and the waiting connector 11 are to be separated from each other, it is only necessary to follow the inverse process to that described above. When the connecting elements 27 *a* are pinched by the connecting terminals on the side of the indoor side wire harness, the joining force therebetween is large due to the fact that these connecting elements are present in multiple. Hence, when the relay box 10 and the waiting connector 11 are separated from each other by inversely rotating the bolt 60, initially the bolt 60 itself rises a little as the above-mentioned joining force is large. However, after the stopper 62 fitted around the bolt 60 has butted against the ceiling portion of the upper space 64, the connector 41 would descend and the connecting elements 27*a* are withdrawn from the connecting terminals at the cord ends.

As described above, in the above-described embodiment, since the joint box 4 is mounted on the dashboard between the car room 1 and the engine room 2, it is only necessary that in the engine room 2 (on the outdoor side) the outdoor side wire harness 7 is led to the relay box 10 in a concentrated manner, while in the car room (on the indoor side) the indoor side wire harness 12 is led to the waiting connector 11 in a concentrated manner. And thereafter, if the relay box 10 and the waiting connector 11 are coupled to each other in the above-described fashion, the wiring is completed, and therefore, the wiring work is extremely easy. In maintenance also, since the relay box 10 and the waiting connector 11 can be simply separated from each other, and since the relay box 10 is disposed within the upper portion of the joint box 4, checking for wirings, replacement of fuses and the like can be done easily.

As the joint box 4 is mounted nearly horizontally to the upper portion 3*a* of the dashboard 3, and especially to the partly raised portion 3*c* thereof, the mounting work for the joint box 4 is easy. Moreover, since the water coming to the somewhat inclined upper surface of the dashboard 3 would flow along the opposite sides of the raised portion 3*c* of the dashboard 3 so as to avoid the raised portion 3*c*, and since the water tending to enter into the joint box 4 from the above is intercepted by the lid 14, water-proofness is very excellent.

The resin cover 5 covering the upper side of the dashboard 3 affords smart appearance and also as the lid 5*b* is mounted to the portion of this resin cover 5 corresponding to the joint box 4, repair works can be simply done by removing the lid 5*b*without dismounting the resin cover 5.

Since it suffices that the outdoor side wire harness 7 is fitted in the notch 5*a* of the resin cover 5 when the resin cover 5 is mounted, the work of passing a wire harness through a hole can be spared, and so, the wiring work is facilitated.

The joint box 4 is disposed at the upper portion 3*a* of the dashboard 3 and on the side of the assistant's seat where relatively enough room in space exits, and so, it would not obstruct the steering handle, the pedals and the like on the side of the driver's seat.

In addition, upon joint and separation of the joint box 4, since the connecting elements 27*a* are engaged with or disengaged from the connecting terminals at the cord ends while the connector 41 integrated with the nut 45 is being slid by rotating the bolt 60, the joint and separation can be made with a small force owing to the force-multifying capability of a screw. Moreover, an unreasonable force would not act upon the dashboard 3 supporting the joint box 4.

Furthermore, owing to the facts that the connector guide 40 can be easily mounted to the dashboard 3 by making use of the elongated slot 40*b*, that the connector 41 can be temporarily fixed by supporting it from the lower stopper portion 40*c* of the connector guide 40, that centering between the outer case 20 and the waiting connector 11 can be achieved by making use of the protrusion 40*a* of the connector guide 40 and the guide plate 24 of the outer case 20, and that relative positioning between the connecting elements 27*a* and the through-holes 42 can be done easily and reliably by the cooperation of the guide slot 46 and the guide plate 23, it is possible to perform the joining work exactly and in a short period of time.

It is to be noted that while the relay box 10 also serves as one of connectors in a connecter arrangement in the above-described embodiment, the relay box and the one connector could be formed as separate units.

FIG. 8 to 11 are cross-section views similar to FIGS. 4 to 7, respectively, but showing a different preferred embodiment of the present invention. Since this embodiment is constructed almost in a similar manner to the above-described first embodiment, equivalent component parts are given like reference numerals, and further explanation thereof will be omitted. As will be seen by comparing, for instance, FIG. 8 with FIG. 4, this preferred embodiment is different from the above-described first embodiment in the following point. In contrast to the fact that in the first preferred embodiment the top surfaces of the nut 45 and the cylindrical portion supporting the same nut are located higher than the top surface of the connector 41, in this second preferred embodiment the top surfaces of the nut 45 and the cylindrical portion supporting the same nut are located lower than the top surface of the connector 41. More particularly, in this preferred embodiment, the inlet surface of the nut 45 is retracted deeper than the inlet surface of the guide slot 46. Furthermore, in this preferred embodiment, the guide plate 23 projects downwards from the bottom surface of the outer case 20.

Figure 8:
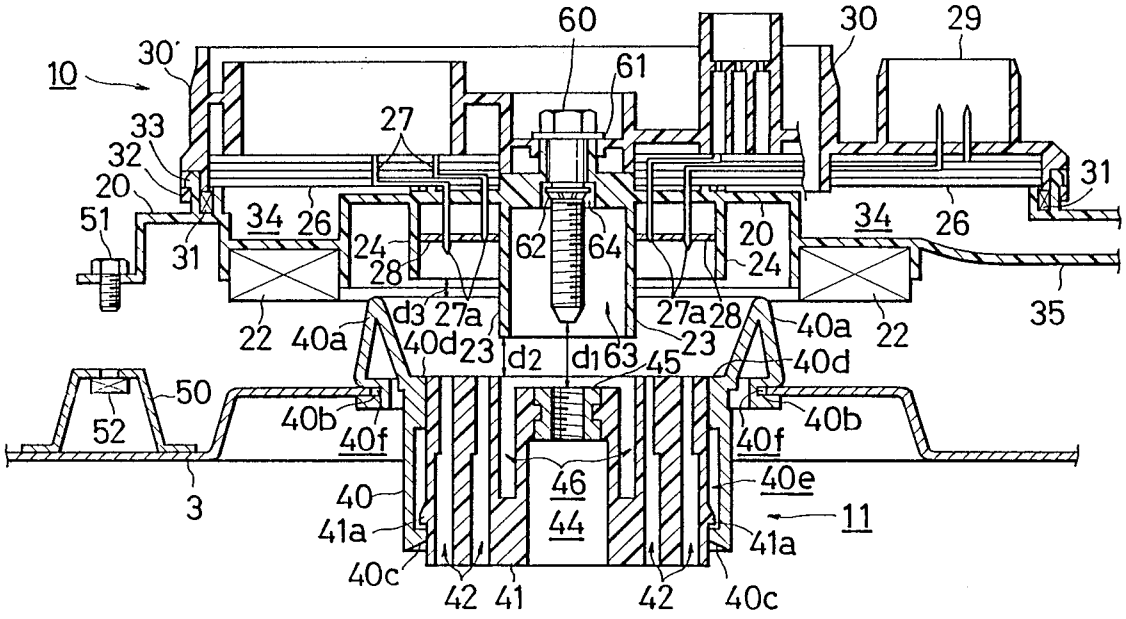
FIG. 8, 9, 10 and 11 are cross-section views showing the successive steps of a joining process between a relay box and waiting connector in a joint box according to another preferred embodiment of the present invention.
Figure 9:
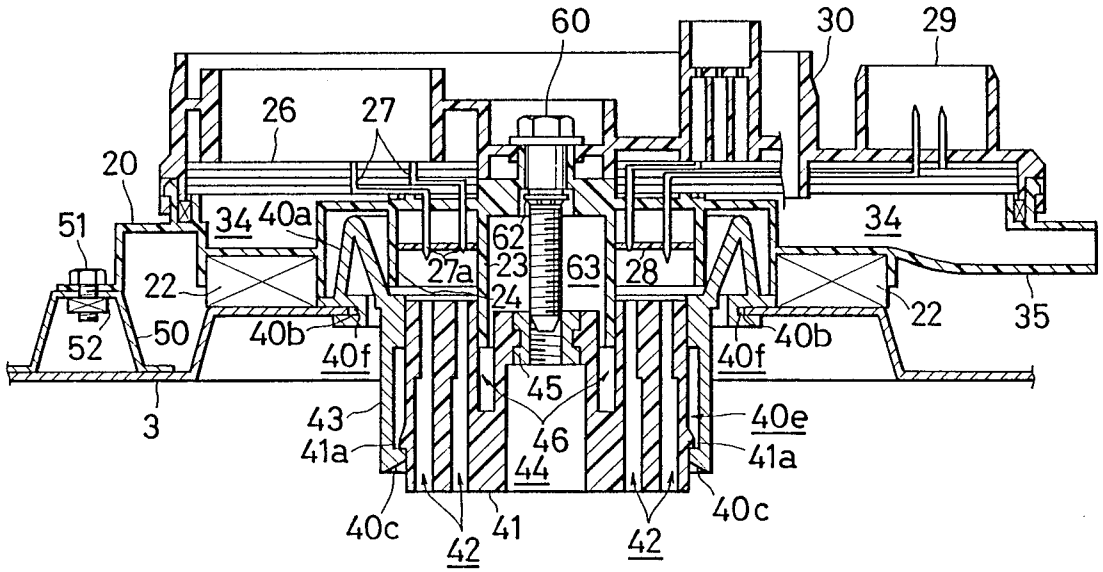
Figure 10:
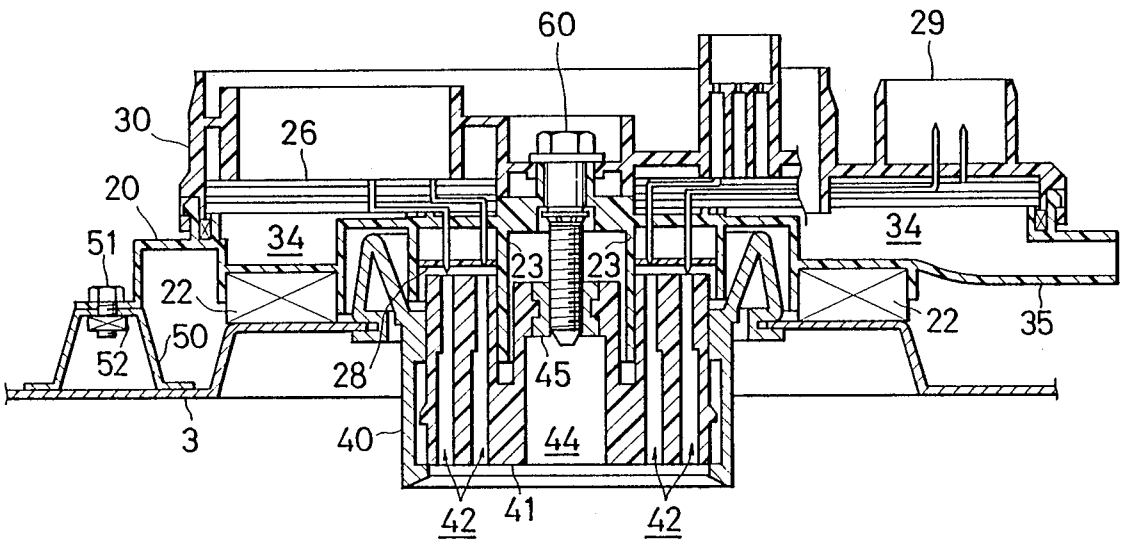

In this modified embodiment, as shown in FIG. 8, the relation that the distance $d_1$ from the tip end of the bolt 60 to the inlet surface of the nut 45 is always larger than the distance $d_2$ from the tip end of the guide plate 23 to the inlet surface of the guide slot 46, is established, and the relation that this distance $d_2$ is always larger than the distance $d_3$ from the tip end of the guide plate 24 to the protrusion 40*a* of the connector guide 40, is also always realized. Accordingly, when the relay box 10 is placed on the waiting connector 11, even if there exists some positional deviation in the horizontal direction therebetween, before the tip end of the guide plate 23 butts against the upper surface of the connector 41, the tip end of the guide plate 24 is guided by the protrusion 40*a* of the connector guide 40, and moreover, before the tip end of the bolt 60 butts against the nut 45 or its proximity, either the tip end of the guide plate 23 would be favorably inserted into the guide slot 46 or it would strike against the proximity of the inlet of the guide slot 46, and hence, it can be prevented that the bolt 60 made of metal may possibly damage the upper surface of the connector 41.

Figure 11:
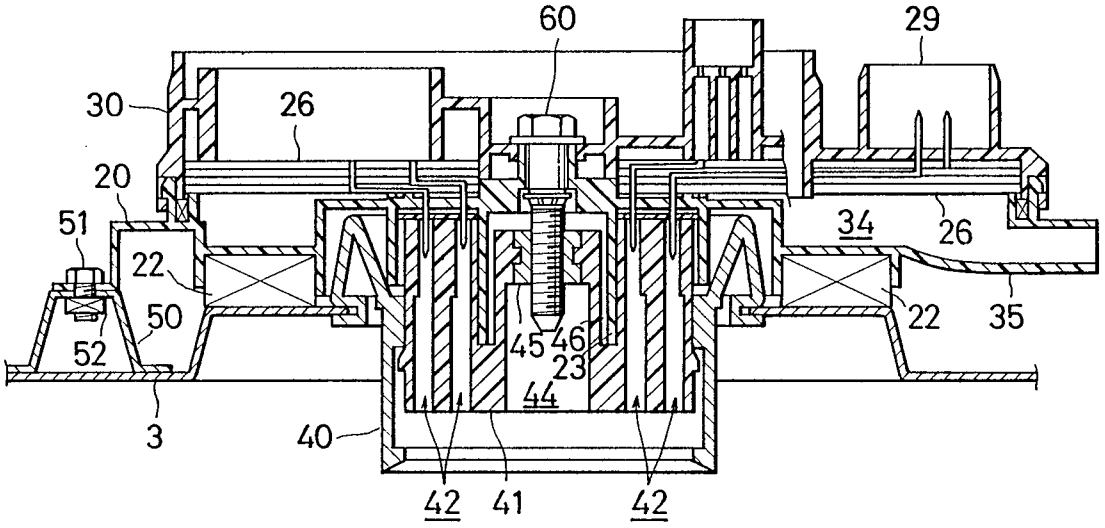

As will be seen from FIG. 11, in this preferred embodiment, the rise of the connector 41 stops in response to butting of the tip end of the guide plate 23 against the bottom of the guide slot 46, and at this time a little gap space is present above the nut 45.

Figure 12:
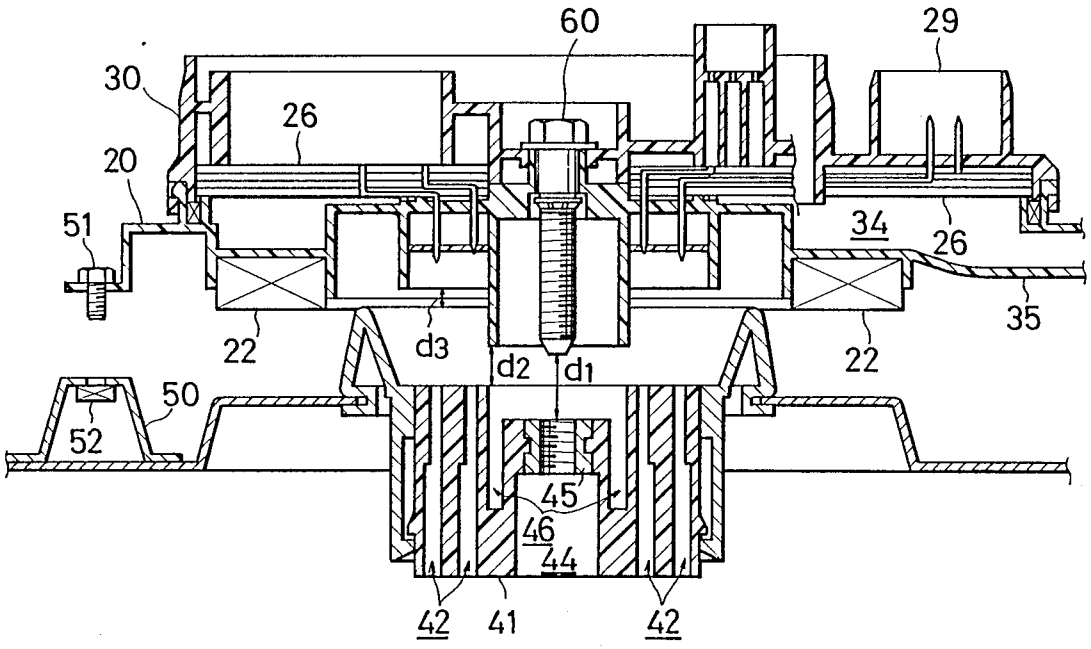
FIG. 12 is a cross-section view of a joint box showing a modification of the preferred embodiment shown in FIGS. 8 to 11.
Figure 13:
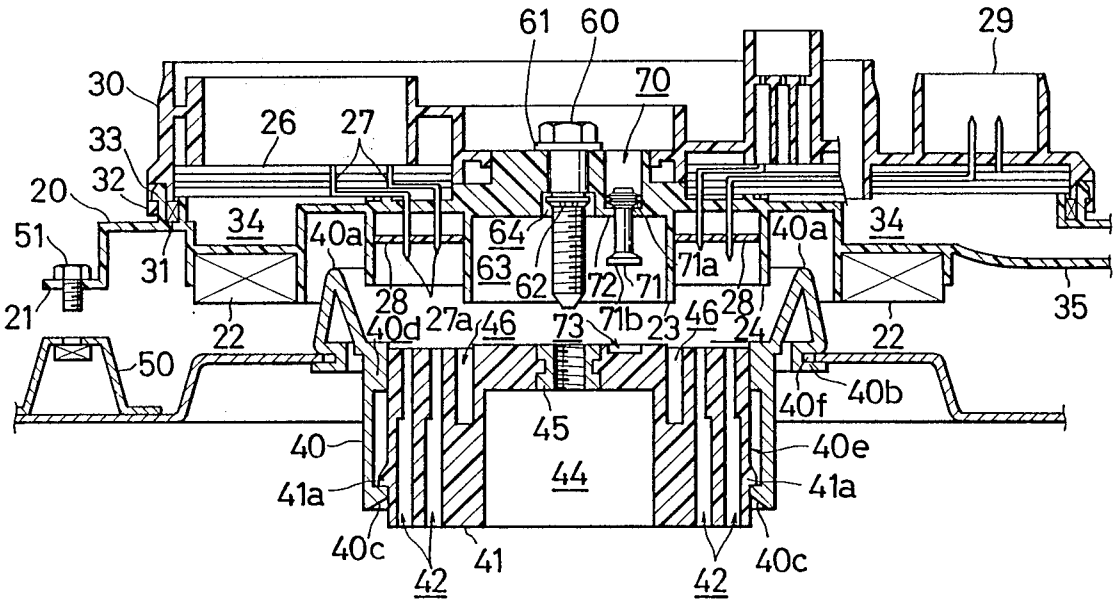
FIG. 13, 14, 15 and 16 are cross-section views showing the successive steps of a joining process between a relay box and a waiting connector in a joint box according to still another preferred embodiment of the present invention.

In a further modified embodiment shown in FIG. 12, the bolt 60 extends further downwards, and the nut 45 is disposed at a lower position by the corresponding distance. In this embodiment also, the relation that the distance $d_1$ from the tip end of the bolt 60 to the inlet surface of the nut 45 is larger than distance $d_2$ from the tip end of the guide plate 23 to the inlet surface of the guide slot 46, is maintained.

FIGS. 13 to 16 are cross-section views similar to the above described FIGS. 4 to 7, respectively, or the above-described FIG. 8 to 11, respectively, but showing still another preferred embodiment of the present invention. In these figures, compornent parts equivalent to those of the above-described respective embodiments are given like reference numerals, and further explanation thereof will be omitted.

In this particular embodiment, in the central portion of the outer case 20 is drilled a bore 70 adjacent to the bolt 60 and in parallel to the bolt 60, and this bore 70 opened to the space within the inner case 30 at the above. At the bottom of the bore 70 is formed a circular hole having a smaller diameter than that of the bore 70, and the bore 70 communicates with the lower space 63 of the outer case 20 through this circular hole. And a rod-like pin 71 made of elastic material such as rubber, penetrates through the circular hole. The pin 71 has flanges 71*a* and 71*b*, respectively, at its upper and lower ends, and the upper flange 71*a* is adapted to be supported by the bottom 72. The pin 71 can rise in the bore 70 when its bottom end is pushed upwards. On the other hand, on the top surface of the connector 41 is formed a shallow circular recess 73 corresponding to the pin 71 at a position on the radially inside of the guide slot 46.

Figure 14:
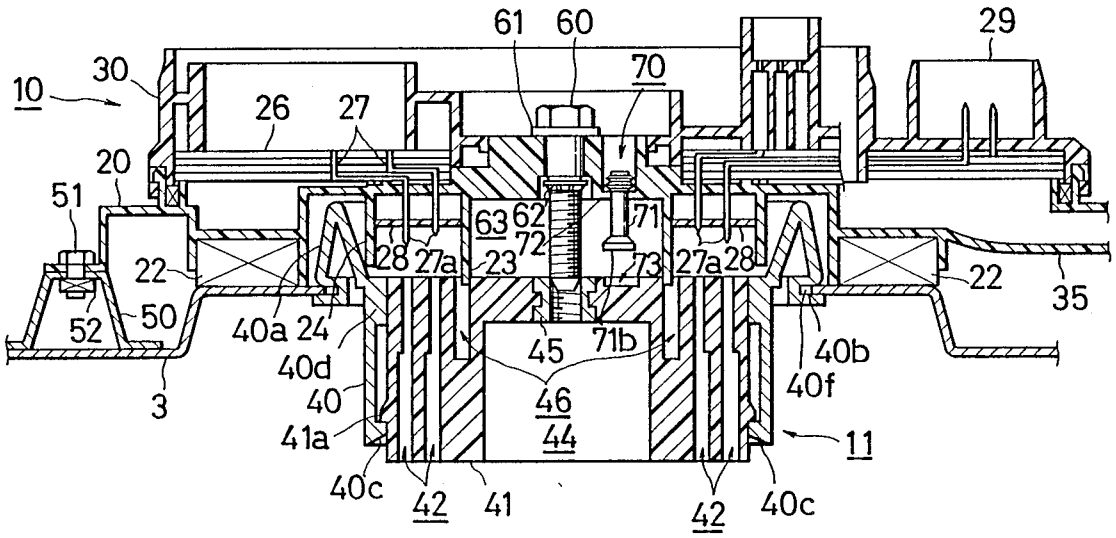
Figure 15:
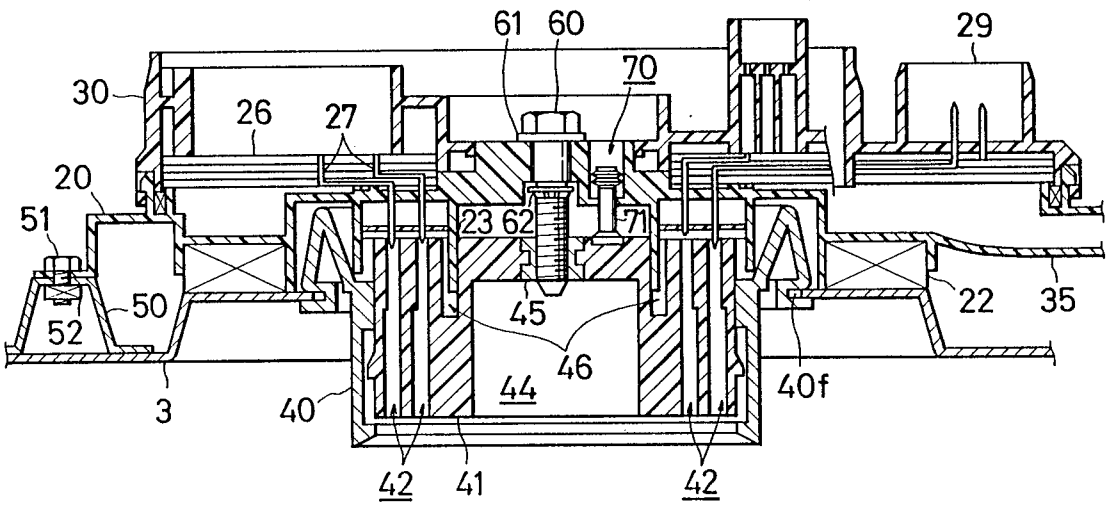
Figure 16:
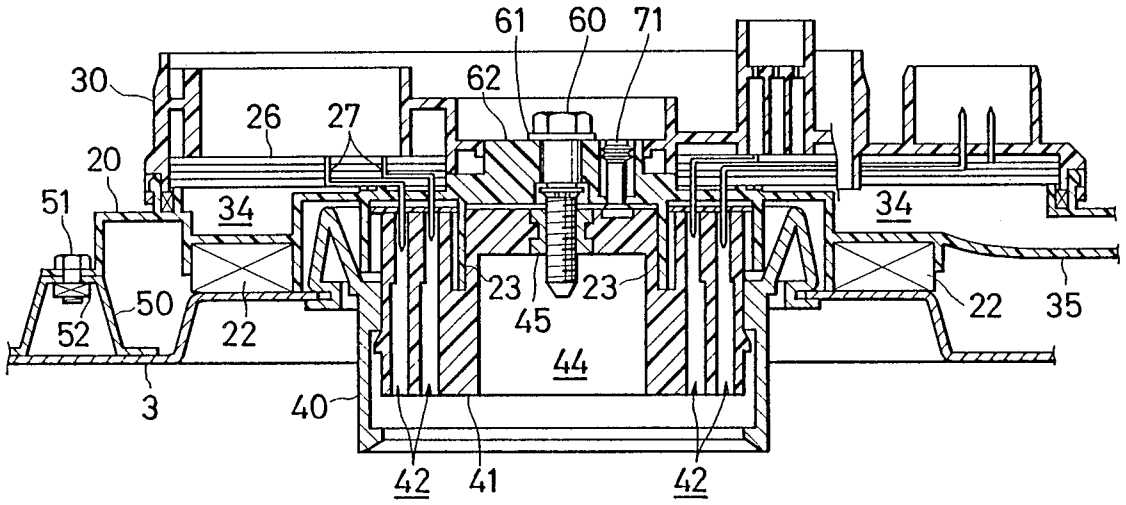

As shown in FIG. 14, under the condition where the relay box 10 has been placed on the waiting connector 11, the bottom end of the pin 71 has not yet come into contact with the connector 41. Subsequently, when the connector 41 rises in response to rotation of the bolt 60, in the midway the bottom end of the pin 71 fits into the circular recess 73 of the connector 41, and thereafter, the pin 71 rises jointly with the connector 41 (See FIG. 15). When the relay box 10 and the waiting connector 11 have been perfectly joined, as shown in FIG. 16, the top surface of the pin 71 becomes flush with the top surface of the outer case 20 supporting the bolt 60, and thereby, it can be externally confirmed that the joint between the relay box 10 and the waiting connector 11 has been perfectly finished.

Similarly to the embodiment shown in FIGS. 8 to 11, the rise of the connector 41 is stopped by the bottom end of the guide plate 23 butting against the bottom of the guide slot 46, but in place of such arrangement, modification could be made such that the rise of the connector 41 may be stopped by the flange 71*b* at the bottom of the pin 71 striking against the bottom 72 of the bore 70.

Since the pin 71 is positioned in the proximity of the bolt 60, a worker can easily confirm the rising position of the connector 71 by looking at the mode of rising of the pin 71 while rotating the bolt 60.

Figure 17:
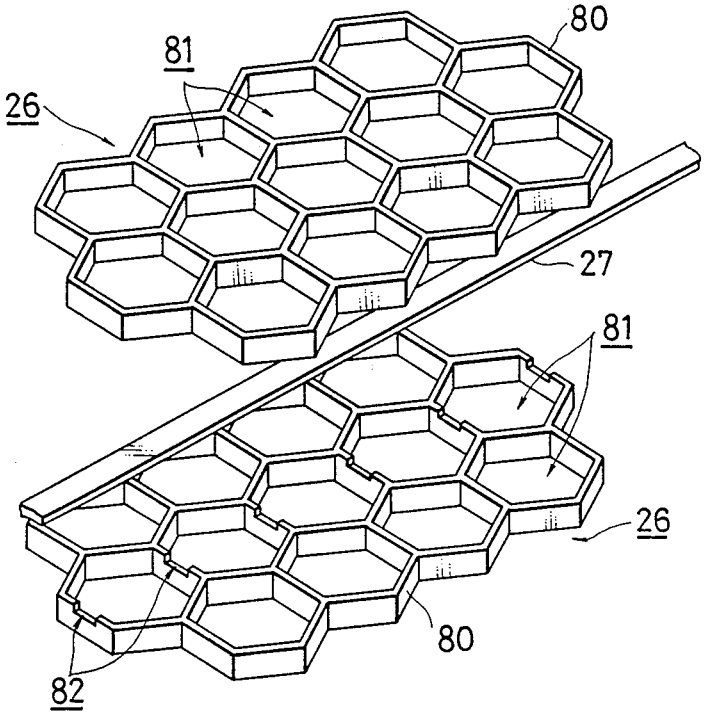
FIG. 17 is a disassembled perspective view for explaining a structure of separators within a relay box.

Finally, description will be made on the structure of the separators 26. As shown in FIG. 17, each separator 26 is constructed of a frame body 80 made of resin and having a honeycomb-like configuration in which a large number of through-holes 81 of hexagonal shape are provided. A bus bar 27 is laid as sandwiched by these separators 26 from the above and the below thereof. In the lower layer separator 26 are formed notches 82 into which the bus bar 27 is to be fitted, and since the bus bar 27 is fitted into these notches 82, the upper and lower separators 26 are held in tight contact with each other.

Figure 18:
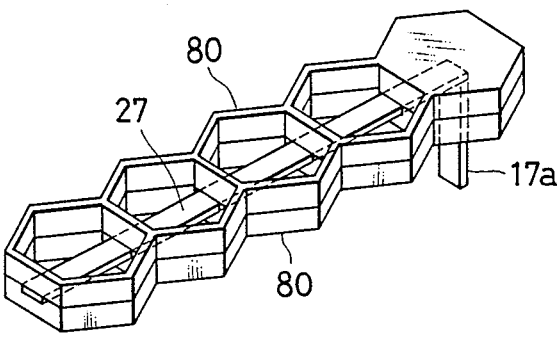
FIG. 18 is a partial perspective view showing assembled separators.
Figure 19:
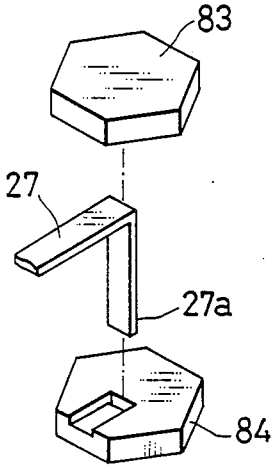
FIG. 19 is a disassembled perspective view showing a structure of separators at a bent portion of a bus bar.
Figure 20:
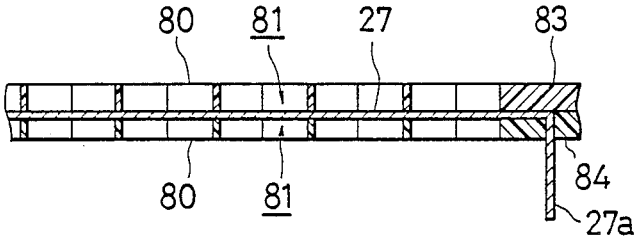
FIG. 20 is a cross-section view of separators.

FIG. 18 is a perspective view of an essential part showing the state where the separators 26 and the bus bar 27 have been assembled. The upper and lower separators 26 are superposed so that their hexagonal through-holes 81 may align with each other. And, resin is filled in the space within the through-holes 81 of the upper and lower frame bodies 80 at the portion of the bus bar 27 where the bus bar 27 is bent downwards to form the connecting element 27*a*. More particularly, as shown in FIGS. 19 and 20, the frame body 80 in the upper layer at the portion of the connecting element 27*a* is a solid hexagonal column 83, and the frame body 80 in the lower layer at the portion is a solid body 84 filled with resin except for the above-mentioned notch 82 in the horizontal direction and a through-hole into which the connecting element 27*a* is to be inserted. As the connecting element 27*a* is firmly fixed to the separator 26 in the above-described manner, the connecting element 27*a* and the bus bar 27 would not be deformed upon insertion and separation of the connectors.

Since the separators 26 are formed in a honeycomb-like configuration having a large number of through-holes 81, even if water should invade into the relay box 10 (although the upper side of the relay box 10 is covered by the lid 14 so that basically invasion of water can be prevented), this water would come to the lower space 34 through the separator 26, and then it is extracted to the outside through a draining hose 35. In addition, since a ventilation property within the relay box 10 is excellent owing to the existence of the through-holes 81, the water would evaporate naturally, and the water would not stagnate for along period of time. Furthermore, as a principal passageway of water if formed by the through-holes 81, water would not permeate through the interstices between the upper and lower frame bodies 80.

Figure 21:
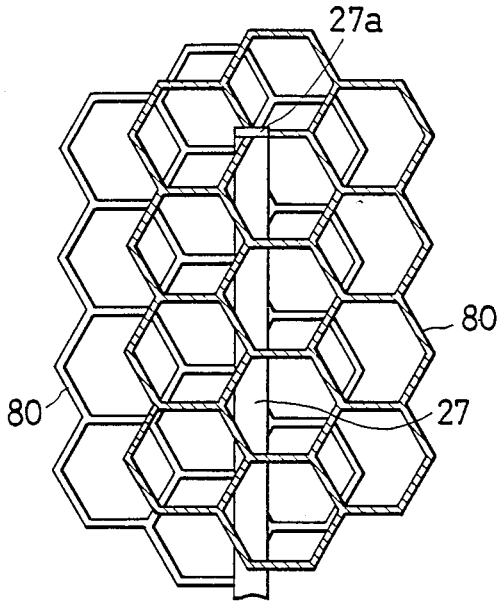
FIG. 21 is a bottom view showing a separator structure according to a different preferred embodiment of the present invention.

FIG. 21 shows a modified embodiment, in which upper and lower separators 26 are superposed on each other with their through-holes 81 displaced from each other. If the bent portion of the bus bar 27 is positioned at a selected place where frame bodies are present both above and below the bent portion and cut-out portions for inserting the connecting element 27*a* are provided in the lower frame body portions, the portion 27*a* can be fixed without filling the through-holes 81 with resin or the like.

Figure 22:
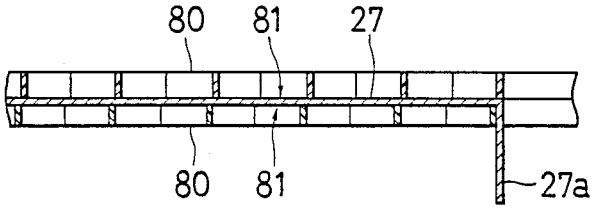
FIG. 22 is a cross-section view of separators according to a further different preferred embodiment of the present invention.

Alternatively, as shown in FIG. 22, modification could be made such that the upper and lower frame bodies 80 are displaced by a distance corresponding to the wall thickness of the frame body 80, the base end portion of the connecting element 27*a* is received by the lower surface of the wall of the frame body 80 at the above, and the side surface of the connecting element 27*a* is placed along the side surface of the wall of the frame body 80 at the below.

The cross-section configuration of the through-holes 81 is not limited to a hexagonal shape, but various configurations such as triangular, rectangular, circular and other shapes can be conceived.

What is claimed is:

1. A wiring joint structure in a vehicle, comprising:

a connector guide having an end mounted to a partition wall, bounding an indoor side and an outdoor side of the vehicle, penetrating through a hole formed in said partition wall, said connector guide having a clip-like projection for temporarily fixing said connector guide to said partition wall;

a first connector positioned opposite to said end of the connector guide;

a second connector positioned within said connector guide to receive said first connector, said second connector slidably supported by said connector guide;

a bolt member provided rotatably on said first connector; and a nut member fixed to said second connector as directed in a sliding direction thereof;

wherein making the first and second connectors butt against each other in a predetermined positional relationship and rotating said bolt member, said bolt member is threadedly inserted into said nut member, said second connector slides along said connector guide, and connect elements provided in respective connectors are therein connected with each other.

2. A wiring joint structure as claimed in claim 1, in which said connector guide has a stopper portion for restraining the sliding of said second connector and also for supporting said second connector.

3. A wiring joint structure as claimed in claim 1, in which said connector guide includes means for making said second connector movable in a direction nearly at right angles to the sliding direction thereof.

4. A wiring joint structure as claimed in claim 3, said clip-like projection is provided with said means for making said second connector movable in the direction nearly at right angles to the sliding direction thereof.

5. A wiring joint structure as claimed in claim 4, in which said clip-like projection has a guide surface for guiding said first connector, and said guide surface has a shape flared from said second connector side towards said first connector side.

6. A wiring structure having a wiring joint structure as claimed in claim 1, in which a horizontal partition wall portion is formed in the partition wall bounding the indoor side and the outdoor side of the vehicle, an end portion of a harness disposed on the outdoor side is positioned above said partition wall portion and connected with said first connector, while an end of a harness disposed on the indoor side is positioned under said partition wall portion and connected with said second connector, said outdoor side harness and said indoor side harness are therein connected with each other via said connectors at said partition wall portion.

7. A wiring structure as claimed in claim 6, in which said outdoor side harness and said indoor side harness are connected with each other at one end portion of said partition wall portion extending in a lateral direction of a vehicle body.

8. A wiring structure as claimed in claim 6, in which said first connector is formed integrally with a relay box.

9. A wiring structure as claimed in claim 6, in which the first connector and the second connector are connected with each other at an end portion on a side of an assistant's seat of said partition wall portion.

10. A wiring structure as claimed in claim 6, in which said partition wall portion forms an upper portion of a dashboard.

* * * * *